US005821836A

United States Patent [19]

Katehi et al.

[11] Patent Number: 5,821,836

[45] Date of Patent: Oct. 13, 1998

[54] MINIATURIZED FILTER ASSEMBLY

[75] Inventors: Linda P. B. Katehi, Northville; Ioannis Papapolymerou; Jui-Ching Cheng, both of Ann Arbor, all of Mich.

[73] Assignee: The Regents of the University of Michigan, Ann Arbor, Mich.

[21] Appl. No.: 862,722

[22] Filed: May 23, 1997

[51] Int. Cl.[6] ..... H01P 1/20

[52] U.S. Cl. ..... 333/202; 333/230

[58] Field of Search ..... 333/202, 207, 333/230, 246, 247; 257/728

[56] References Cited

U.S. PATENT DOCUMENTS

| | | | |
|---|---|---|---|
| 4,211,987 | 7/1980 | Pan | 333/230 |
| 4,758,922 | 7/1988 | Ishigaki et al. | 361/330 |
| 5,023,503 | 6/1991 | Legge et al. | 310/311 |
| 5,216,631 | 6/1993 | Sliwa, Jr. | 365/174 |
| 5,260,596 | 11/1993 | Dunn et al. | 257/414 |
| 5,307,311 | 4/1994 | Sliwa, Jr. | 365/174 |
| 5,363,067 | 11/1994 | Crandall et al. | 331/107 SL |
| 5,396,202 | 3/1995 | Scheck | 333/230 |
| 5,455,547 | 10/1995 | Lin et al. | 333/186 |
| 5,491,604 | 2/1996 | Nguyen et al. | 361/278 |
| 5,493,177 | 2/1996 | Muller et al. | 313/578 |
| 5,537,083 | 7/1996 | Lin et al. | 333/186 |
| 5,569,871 | 10/1996 | Wheaton et al. | 84/625 |
| 5,589,082 | 12/1996 | Lin et al. | 216/2 |
| 5,594,331 | 1/1997 | White et al. | 324/117 R |
| 5,608,263 | 3/1997 | Drayton et al. | 257/728 |

OTHER PUBLICATIONS

Chen–Yu Chi, "Planar Microwave and Millimeter–Wave Components Using Micromaching Technologies", Ph.D. Dissertation, The University of Michigan, 24–39, 1995.

Kai Chang, "Handbook of Microwave and Optical Components", John Wiley & Sons, New York, NY, 196–198, 1989.

R.E. Collin, "Foundations for Microwave Engineering", New York; Mc–Graw–Hill Publishing Company, 322–325, 1966.

R.F. Drayton and L. Katehi, "Experimental Study of Micromachined Circuits", Digest of the 1993 International Symposium on Space Terahertz Technology, Los Angeles, CA, 238–248, Mar. 1993.

J. Cheng, N. Dib, and L. Katehi, "Theoretical Modeling of Cavity–Backed Patch Antennas Using a Hybrid Technique", IEEE Trans. on Antennas Propagat., vol. AP–43, No. 9, 1003–1013, Sep. 1995.

R. Drayton, T. Weller, and L. Katehi, "Development of Miniaturized Circuits for High–Frequency Applications Using Micromachining Techniques", The International Journal of Microcircuits and Electronic Packaging, vol. 18, No. 3, 217–223, Third Quarter 1995.

R. Drayton and L. Katehi, "Microwave Characterization of Microshield Lines", Digest of the 40th ARFTG Conference, Orlando, FL, Dec. 1992.

R. Drayton and L. Katehi, "Micromachined Circuits for Mm–Wave Applications", Digest of the 1993 European Microwave Conference, Madrid Spain, Sep. 1993.

D. Pozar, "Microwave Engineering", Addison–Wesley Publishing Co., New York, 1990.

*Primary Examiner*—Seungsook Ham
*Attorney, Agent, or Firm*—Young & Basile, P.C.

[57] ABSTRACT

A high frequency micromachined filter assembly comprises at least one microresonator having at least one metal-lined resonance chamber and at least two openings. Input means couples an electromagnetic input signal to the resonance chamber through a first one of the openings. The output signal is coupled to output means from the resonance chamber through a second one of the openings. Dielectric material is arranged between the input means and the resonance chamber to maintain the resonator and the input means separated from one another. Dielectric material is arranged between the output means and the resonance chamber to maintain the resonator and the output means separated from one another.

27 Claims, 3 Drawing Sheets

MINIATURIZED FILTER ASSEMBLY

STATEMENT OF GOVERNMENTAL SUPPORT

This invention was made with support from the U.S. Army Research Office under Contract Number DAAH-04-96-1-0001.

FIELD OF THE INVENTION

This invention relates to miniaturized or micromachined circuits, and more specifically to filters and multiplexers that provide improved performance for high frequency applications.

BACKGROUND OF THE INVENTION

The implementation of Monolithic Microwave Integrated Circuits (MMIC's) in high frequency communication, navigation and radar systems has increased the need for compact low-loss, narrow-band filters and multiplexers. Filters and multiplexers have resonators as building blocks, and two types are common. In one case, a microstrip or stripline resonator is printed on a dielectric material; in another case, the resonator is suspended in air in combination with a dielectric membrane. However, microstrip and stripline resonators have a poor quality factor (Q) when used as filters or multiplexers providing unacceptably high insertion loss and bandwidths exceeding 10%. For narrower bandwidths and even smaller insertion loss relatively bulky, metallic waveguides are used. These metallic waveguide components have Q's on the order of thousands, but the large size and weight and high manufacturing costs prohibits their use with compact, miniaturized circuits. Furthermore, bulky, metallic waveguides cannot be easily integrated with monolithic circuits since extra transitions from waveguide to monolithic technology are required. Thus, a need exists for compact resonators with high Q, small size and weight and low manufacturing cost that are compatible with MMIC's.

SUMMARY OF THE INVENTION

The invention provides a new filter assembly formed as an integral structure for use as a microwave high-Q resonator, providing narrow-band low loss filtering in a planar environment. The resonator is made by micromachining a cavity into a low loss material which is easy to integrate with monolithic circuits.

The invention uses micromachining techniques to fabricate miniature silicon micromachined resonance chambers as building blocks for the development of high-Q band-pass filters. The quality factor that can be achieved by use of the resonance chambers is higher than the quality factor of traditional microstrip resonators either printed on a dielectric material or suspended in air with the help of a dielectric membrane. In one embodiment, a high-Q filter geometry comprises input and output microstrip lines and cavities contained in different dielectric layers. The cavities are made by Si micromachining and the cavities are metallized by conventional techniques, forming resonance chambers. Coupling between the resonance chambers and microstrip lines is achieved via the slots etched at appropriate locations with respect to the microstrip lines. Coupling between resonance chambers is controlled by the size, position, and orientation of the corresponding coupling slots. Both vertical and horizontal arrangement of resonance chambers is possible. The vertical stacking of the resonance chambers greatly reduces the occupied area when multiple resonance chambers are needed for filter design.

The monolithic resonator of the invention provides very high Q factor on the order of 250 or higher, typically 300 or higher, and as high as 1,000 or more. Yet, the resonators of the invention have a maximum dimension less than one centimeter, smaller than one half centimeter or even of sub-millimeter size.

Compared to conventional bulky, metallic resonators, the performance of the resonator of the invention is remarkable given that the weight and size are significantly reduced. Conventional microwave high-Q resonators made by metallic rectangular or cylindrical waveguides are heavy in weight, large in size and costly to manufacture. Conventional resonators do not allow for an easy integration with monolithic integrated circuits.

These and other objects, features, and advantages will become apparent from the following description of the preferred embodiments, claims, and accompanying drawings.

DETAILED DESCRIPTION OF THE PREFERRED EMBODIMENTS

Figure 1A:
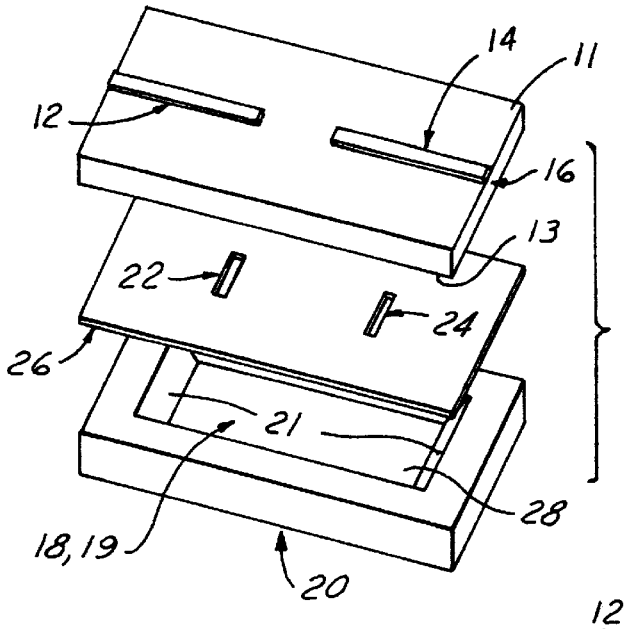
FIG. 1*a* is an exploded perspective view of a micromachined, high-Q, low loss filter with one cavity-resonator in accordance with this invention.
Figure 1B:
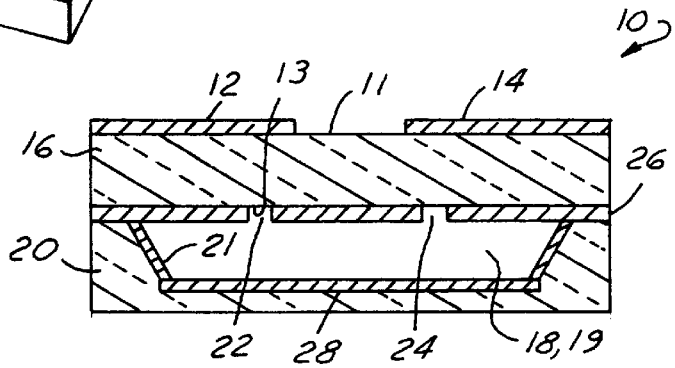
FIG. 1*b* is a cross sectional view of the device depicted in FIG. 1*a*.

As shown in FIGS. 1*a* and 1*b*, in which one of the embodiments of the present invention is illustrated, a micromachined filter assembly 10 is formed by two wafers 16 and 20. The exterior face 11 of wafer 16 has microstrip lines 12 and 14 printed on it by using standard photolithographic techniques. Microstrip lines 12 and 14 serve as the input/output means to the filter 10 and can be connected to other circuits that are on the same or different wafers. Preferably, wafers 16 and 20 extend beyond the edge boundaries depicted in FIGS. 1*a* and 1*b* in order to incorporate more circuits. The interior face 13 of wafer 16, as can be seen in FIGS. 1*a* and 1*b*, is lined with a layer of metal 26 that serves as the ground for microstrip lines 12 and 14. The layer of metal 26 is continuous except for slots 22 and 24. These slots 22,24 are through-openings for coupling electromagnetic energy between microstrip lines 12,14 and the resonance chamber 19 that is formed by micromachining a cavity 18 in wafer 20 and lining it with metal layer 28. The depth at which wafer 20 is etched depends on the size of cavity 18, but should not be more than the height of wafer 20 itself. If the size of cavity 18 requires an etch depth larger than the height of wafer 20 then more than one wafer can be used as will be shown in FIG. 2. The exemplary structure of FIGS. 1*a* and 1*b* is symmetric. Cavity 18 is metal-lined, preferably by deposition of a thin metal layer 28 in cavity 18, to form a resonance chamber 19. Here, in one embodiment, electromagnetic energy enters into the resonance chamber 19, formed in cavity 18, from microstrip line 12 by coupling via slot 22 and then exits from the resonance chamber 19 to microstrip line 14 via slot 24. In an alternative embodiment, the electromagnetic energy follows a path reverse that described above, entering resonator 19 from line 14 via slot 24 and exiting resonator 19 via slot 22 to line 12. Metal-lined cavity 18 forms a resonator 19 that performs the filtering around a certain frequency $f_o$. More specifically, wafers 16 and 20 are bonded together in order to form filter 10 and ensure that ground metal layer 26 and metal-lining layer 28 are in good electric contact.

The fabrication of a filter assembly will now be described with reference to the filter of FIG. 1*a* and 1*b*. The filter assembly of FIGS. 1*a* and 1*b* is prepared using standard photolithographic and micromachining methods. Such methods include etching of a wafer to form a cavity and deposition of metal lining in the cavity. Etching and material deposition methods are known and are described in U.S. Pat. No. 5,608,263, assigned to the assignee of the present invention and having a common joint inventor. The etching and deposition methods of the '263 patent are used to form a shielded container for housing a circuit element to shield such element from interference in dense circuit environments. The etching and deposition techniques of U.S. Pat. No. 5,608,263 are incorporated herein by reference from U.S. Pat. No. 5,608,263 which itself is incorporated by reference in its entirety. Wafers 16,20 are preferably made of a low dielectric loss material such as Silicon (Si), Gallium Arsenide (GaAs) or Indium Phosphide (InP). Such low loss materials preferably have Tan Delta less than or equal to $10^{-2}$. Such low loss materials are essentially electrically insulating. Microstrip lines 12,14 can be printed either by evaporating thin metal layers or by electroplating with a total thickness that ensures low loss. The same principle applies for metal layer 26 and metal layer 28. Preferably, the metal layer is microns thick.

In order to fabricate micromachined cavity 18, wet chemical anisotropic etching is preferably used. For the case of Silicon etching TMAH (Tetra-methylammonium hydroxide) solution or Ethylene-Diamine-Pyrocatechol (EDP) produces the non-vertical side-walls 21 of cavity 18, as seen in FIG. 1*b*. The above mentioned etchants also provide a smooth surface for micromachined cavity 18 after etching. This feature is important in order to reduce the total loss of the filter. Surface roughness increases loss. Wafers 16 and 20 are bonded together, preferably with a low loss adhesive, such as silver epoxy, or by using eutectic bonding. Other techniques such as electrobonding can also be used.

It is important to note that filter assembly 10 can be used over a wide frequency range and that dimensions will vary according to the operating frequency. For example, at lower frequencies the resonance chamber 19 (micromachined cavity-resonator) and the slots will be larger relative to the smaller size required for higher frequencies. The shape of slots 22,24 is not restricted and the rectangular shape is merely exemplary. Any shape that provides adequate coupling between microstrip lines 12,14 and the resonator 19 of cavity 18 can be used. The input and output means are also not restricted and microstrip lines 12 and 14 are merely exemplary. Clearly, the feeding lines are also not limited to microstrip. Any planar transmission line such as coplanar-waveguide (CPW), finite-ground coplanar (FGC) or stripline can be used. Filter assembly 10 has the advantages of narrow-bandwidth (high quality factor Q) and low insertion loss while maintaining planar characteristics that allow for easy integration with monolithic microwave integrated circuits (MMIC's) used in high frequency applications. The quality factor of the filter assembly 10 will increase (bandwidth will decrease) if two or more resonance chambers 19 (micromachined cavity-resonator) are used. Possible configurations of such filters can be seen in FIGS. 2 and 3. It is evident that many variations are possible, using both horizontal and vertical arrangement of adjacent cavities with respective slots for coupling signal between resonance chambers.

Figure 2A:
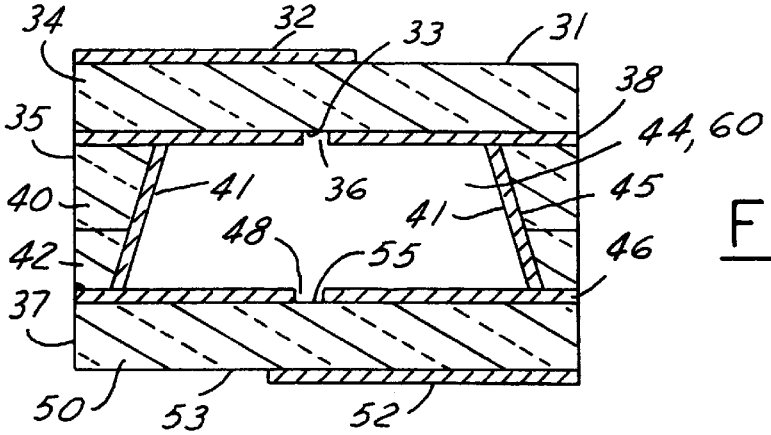
FIG. 2*a* a cross sectional view of a micromachined, high-Q low loss filter that uses two wafers to form a larger cavity-resonator, similar to FIGS. 1*a* and 1*b*, but larger.
Figure 2B:
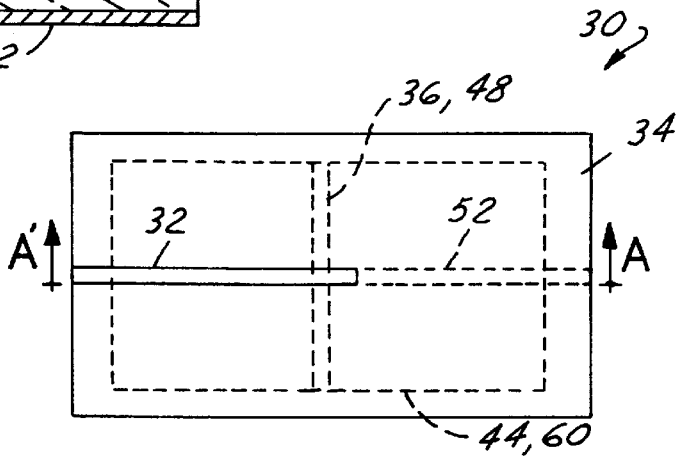
FIG. 2*b* is a the top view of the device shown in FIG. 2*a*.

FIGS. 2*a* and 2*b* show a filter assembly 30. FIG. 2*a* is a cross sectional view along line A-A' of FIG. 2*b*. The exterior face 31 of wafer 34 has microstrip line 32 printed on it, while the inside face 33 of 34 is covered with metal layer 38 except for an opening shown as slot 36. Wafers 40,42 are etched all the way through and micromachined cavity 44 is formed. Proper alignment of the side walls of wafers 40,42 is required. The surface 35 of wafer 40, as well as the surface 37 of wafer 42 are metallized. The side walls 41 of wafers 40,42 are metallized forming metal layer 45. Wafer 50 has microstrip line 52 printed on its exterior face 53, whereas its interior face 55 is metallized with layer 46 except for slot 48. The four wafers 34,40,42,50 are bonded together in order to form the filter assembly 30 which comprises resonance chamber 60, formed by metallized cavity 44. Electromagnetic energy enters the resonator 60 in cavity 44 from microstrip line 32 via slot 36 and exits the cavity to line 52 via slot 48. A reverse path may be used instead as described earlier with respect to FIGS. 1*a* and 1*b*. The filter 30 of FIGS. 2*a* and 2*b* is expected to have a higher quality factor, Q, or narrower-bandwidth than the filter of FIGS. 1*a* and 1*b* since two wafers instead of one are used to form the micromachined cavity.

Figure 3A:
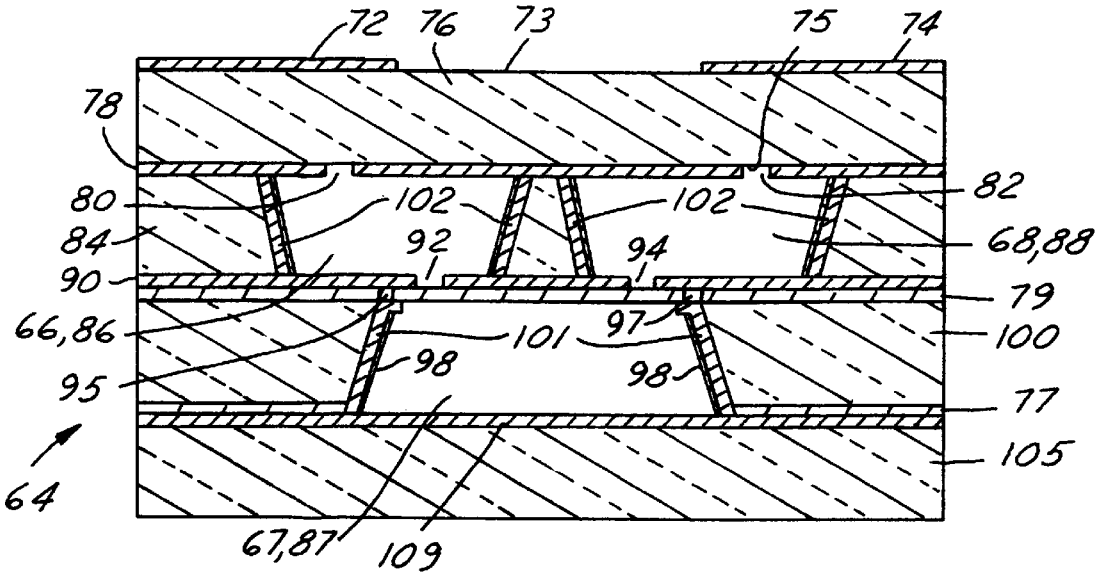
FIG. 3*a* is a cross sectional view of a narrow-band, low-loss filter that uses three adjacent cavity-resonators.

FIG. 3*a* is a cross sectional view of a narrow-band, low-loss filter assembly 64 that uses three adjacent cavity-resonators 66,67,68 in accordance with general teachings of FIGS. 1*a*, 1*b*, 2*a*, and 2*b*. This filter assembly 64 includes adjacent micromachined cavities 86, 87, and 88 formed in and on two different wafers 84, 100. Respective cavities 86, 87, and 88 are metallized to form resonance chambers 66, 67, and 68. Filter 64 is expected to have a higher quality factor than the filters shown in FIGS. 1 and 2 since three cavities are used. On the exterior face 73 of wafer 76 the input/output microstrip lines 72 and 74 are printed. On the interior face 75 of wafer 76 metal layer 78 is formed as a continuous layer except for openings shown as slots 80 and 82. Cavities 66 and 68 are micromachined into the middle wafer 84. Wafer 84 is etched all the way through. The interior side walls 102 of cavities 86 and 88 are metallized to form resonators 66 and 68. The surfaces of wafers 76 and 84 facing one another are metalized. Metallized layer 90 between wafers 84 and 100 is continuous except for openings shown as slots 92 and 94. Wafer 100 has a thin layer of membrane 77, 79 deposited on its respective major surfaces that provide the mechanical support for layer 90. The membrane consists of a thin layer of Silicon Dioxide, a thin layer of Silicon Nitride and another thin layer of Silicon Dioxide. It is widely used in silicon micromachined circuits as a means of support for several structures such as printed lines. Wafer 100 is micromachined to form cavity 67. Wafer 100 is etched all the way through to form cavity 67. The interior side walls 101 of cavity 67 are metallized with metal layer 98. The interior side walls 102 of cavities 66 and 68 are similarly metallized. Via-holes 95 and 97 form an opening in membrane layer 79 and are either metallized or filled in with a low ohmic loss adhesive, such as silver epoxy, in order to ensure good electric contact between metal layer 90 and metallized side walls 101. More specifically, several via-holes are made around in the periphery of cavity 67 for the best possible electric contact. The exterior face of wafer 105 is metallized with layer 109 and layer 109 is also in contact with the surface of wafer 100 which is also metalized. Wafers 76, 84, 100 and 105 are bonded together to form the filter 64. Energy is coupled from line 72 to resonator 66 in cavity 86 via slot 80 and then exits resonator 66 in cavity 86 via slot 92 to enter resonator 67 in cavity 87. Energy then enters resonator 68 in cavity 88 from cavity 87 through slot 94 and finally reaches microstrip line 74 by coupling with the help of slot 82. Each cavity-resonator 66, 67 and 68 provides additional filtering and as a result the filter has a very narrow bandwidth or high Q.

Figure 3B:
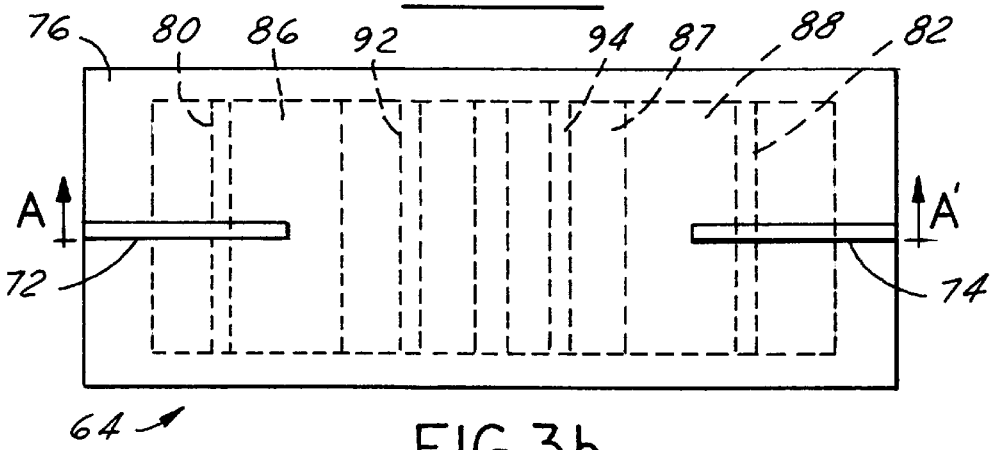
FIG. 3*b* is the top view of the device shown in FIG. 3*a*.
Figure 4A:
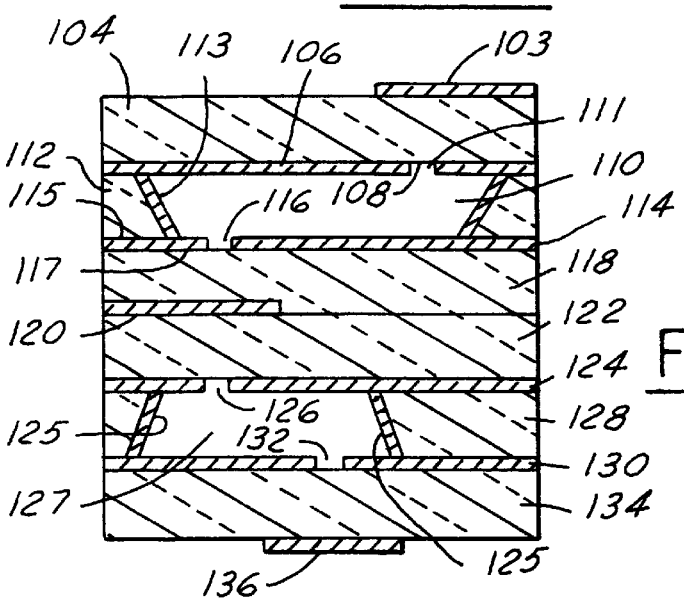
FIG. 4*a* is a cross-sectional view of a low-loss diplexer with two cavity-resonators.
Figure 4B:
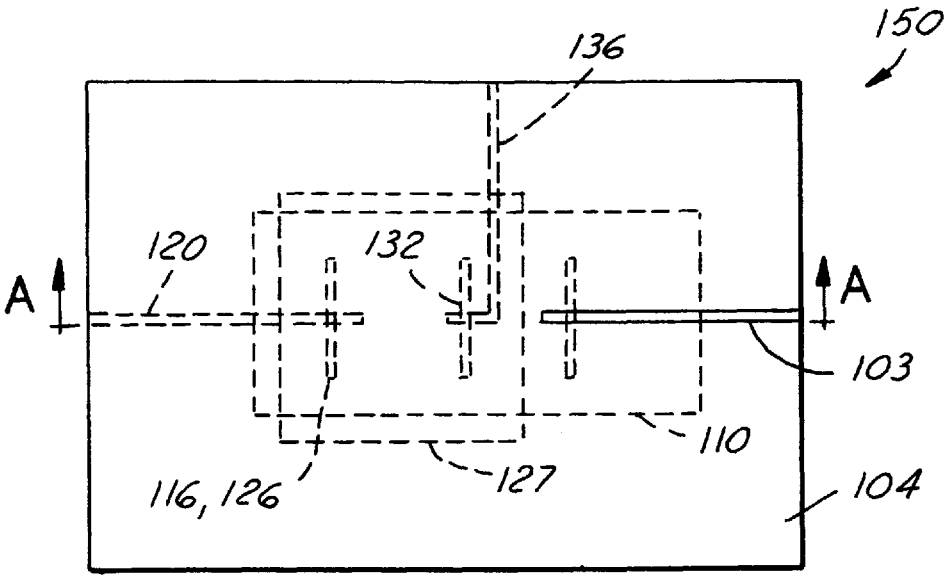
FIG. 4*b* is the top view of the device shown in FIG. 4*a*.

The structures depicted in FIGS. 1–3 are representative filter assemblies with narrow-band and low-insertion loss characteristics around a center frequency $f_o$. It is possible, however, to create a planar diplexer or multiplexer incorporating the micromachined cavity-resonators as shown in FIGS. 4*a* and 4*b* (FIG. 4*a* is a cross sectional view along line A-A' of FIG. 4*b*). A diplexer 150 as shown in FIGS. 4*a* and 4*b,* has an input that contains a signal from two channels, designated here as frequencies $f_1$ and $f_2$ respectively. The cavity-resonators 110 and 127 route a respective channel at a different output. In FIG. 4*a,* wafer 104 has microstrip line 103 printed on its exterior face and metal layer 106 deposited on its interior surface 108 facing wafer 112. Metal layer 106 is continuous except for an opening shown as slot 111. Cavity 110 is micromachined into wafer 112. Wafer 112 is etched all the way through. The surface 115 of wafer 112 facing wafer 118 is metallized with metal layer 114. Metal layer 114 is continuous except for an opening shown as slot 116. The side walls 113 of cavity 110 are metallized. In one embodiment, the surface 117 of wafer 118 facing wafer 112 is metallized with metal layer 114 which includes slot 116. Line 120 is printed on the surface of wafer 118 facing wafer 122. Alternatively, line 120 is printed on the surface of wafer 122 facing wafer 118. In one embodiment, the surface of wafer 122 facing wafer 128 is metallized with layer 124 except for slot 126.

When all of the wafers 104, 112, 118, and 122 are bonded together line 120 is a stripline since it is sandwiched between two wafers 118 and 122 with respective ground planes 114 and 124. Wafer 128 is selectively etched all the way through in order to form cavity 127. The side walls 125 of cavity 127 are metallized. The size of cavity 127 preferably is different from the size of cavity 110. The wafer 134 has metal layer 130 deposited on its surface facing wafer 128 except for slot 132. Microstrip line 136 is printed on the surface of wafer 134 opposite layer 130.

Wafers 104, 112, 118, 122, 128, 134 are bonded together in order to form the diplexer filter assembly 150 which also functions as a multiplexer. The input signal that contains channels $f_1$ and $f_2$ is applied to line 120. Electromagnetic energy is coupled from line 120 partially to cavity 110 through slot 116 and partially to cavity 127 through slot 126. Cavity 110 is designed in such a way that it propagates or supports only channel $f_1$, that is, frequencies centered around $f_1$, and blocks channel $f_2$. As a result, only electromagnetic energy around $f_1$ is coupled from cavity 110 to microstrip line 103 via slot 111. The opposite phenomenon occurs inside cavity 127; channel $f_1$ is blocked and electromagnetic energy around $f_2$ is coupled to microstrip line 136 via slot 132. The final result is that the two channels are separated, with line 103 carrying only channel $f_1$ and line 136 carrying only channel $f_2$.

EXAMPLE

Fabrication and Analysis Methods

An X-band resonator was fabricated using standard micromachining techniques to prepare a circuit essentially as shown in FIGS. 1*a* and 1*b*. Two silicon wafers, 500 $\mu$m thick, with 1.45 $\mu$m thermally grown oxide deposited on both sides were used. To measure the resonator with on-wafer probing, a coplanar waveguide (CPW) to microstrip transition was incorporated to provide a matched transition to the feeding lines. The ground of the CPW and the microstrip were set at an equal potential with the implementation of via holes (slots). The characteristic impedance of both the CPW and microstrip was 50 Ohms. The two microstrip lines were gold electro-plated with a total thickness of 7.5 $\mu$m in order to minimize losses. Infrared alignment was used in order to correctly align the two slots on the back of the wafer with the microstrip lines printed on the other side.

The cavity was fabricated on a second wafer by using chemical anisotropic etching (EDP or TMAH) until a depth of about 465 $\mu$m was achieved. Once the wafer was etched, it was metallized with a total thickness of 2 $\mu$m. The two wafers were then bonded together with silver epoxy that was cured at 150° C. The alignment between the two wafers was achieved by opening windows on the top wafer during the etching process to align to marks that are placed on the second wafer.

In the following discussion, the micromachined assembly described above is analyzed. The theoretically calculated results were compared to measurements. The Q of the resonator was computed and compared to the Q of conventional metallic and planar resonators.

A hybrid technique that combines the method of moment (MoM) and the finite element method (FEM) was used in the theoretical analysis. This technique primarily used the method of moments to analyze the open part of the structure and the FEM to compute the fields inside the cavity. The two techniques were coupled at the slot surface. Due to the flexibility of FEM, the shape of the cavity was not restricted to be rectangular and the cavity can be filled with complex material. The procedure of applying this technique is briefly described below. The exact formulation will not be shown here, since it is similar to the one presented in *Theoretical Modeling of Cavity-Backed Patch Antennas Using a Hybrid Technique,* J. Cheng, N. I. Dib, and P. B. Katehi, IEEE Trans. on Antennas Propagat., Vol. AP-43, No. 9, pp. 1003–1013, September 1995.

Referring back to FIG. 1 there is shown a cavity coupled by two microstrip lines through two slots. By using the equivalence principle, the slots can be replaced by perfect electric conductors with equivalent magnetic currents flowing above their surface at the location of the slots. In this way, the cavity and the microstrip lines are separated by the ground plane of the microstrip lines. The field inside or outside the cavity was represented as an integral of the unknown equivalent current sources dot-multiplied by the dyadic Green's function. By enforcing the continuity of tangential magnetic fields across the slots and using Galerkin's method, a matrix equation linking the unknown current distribution on the microstrip lines and field distribution on the slots was derived. The finite element technique applied in the cavity links the fields on the two slots through an FEM matrix. This hybrid technique reduced to a matrix equation which was then solved to compute the unknown current and field distributions.

Computed and Measured Results

Figure 5:
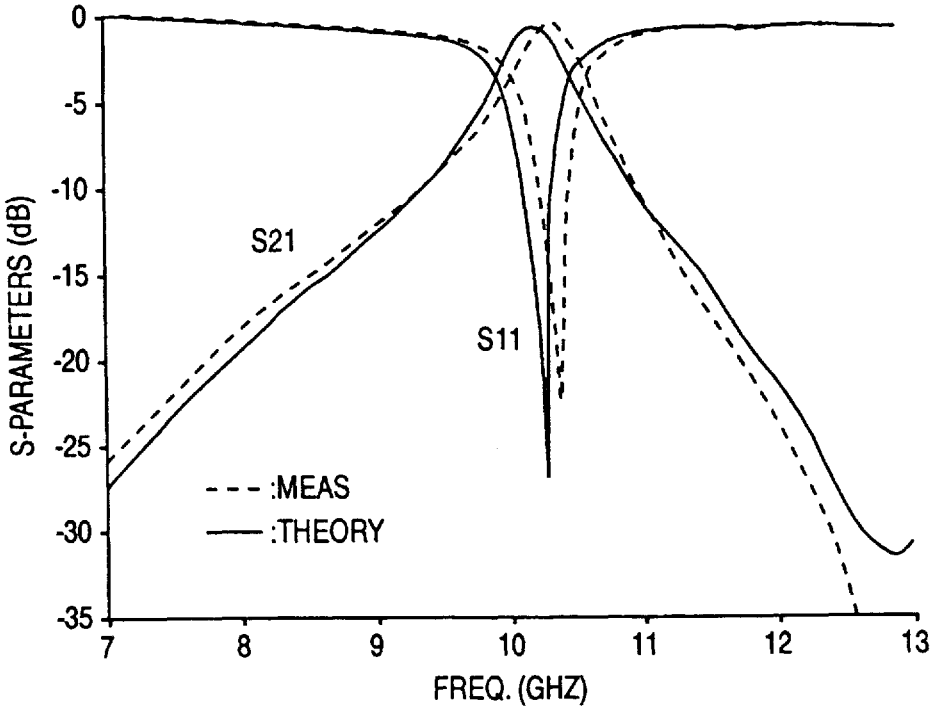
FIG. 5 graph showing measured and theoretical S-paramaters for the resonator of FIG. 1.

A filter assembly having a resonator as described above was built and the S-parameters were measured and compared with the computed results. The reference planes for the measurement were at the middle of the slots and de-embedding was achieved using a TRL (Thru-Reflect Line) calibration with the standards fabricated on the same wafer. Computed and measured results are in FIG. 5. Note that although the cavity was not rectangular, the first resonant frequency was very close to that of a rectangular cavity of similar size. The small difference (1 percent) in the center frequency was partly due to the finite accuracy in modeling the non-vertical slopes of the cavity and partly to the inherent numerical error of simulation technique. A pattern of the z-component electric field density on the bottom of the cavity at the resonant frequency (10.4 GHz) was obtained. The field pattern also matched quite well to that of the first resonant mode of a rectangular cavity of the similar size. The pattern was plotted in scale according to the physical dimension of the cavity. The two coupling slots were identified in the pattern at ¼ and ¾ of the length of the cavity as indicated in the figure.

In order to evaluate the unloaded Q ($Q_u$) of the cavity the losses due to the excess length of the lines from the reference planes, that was needed to tune the slots, must be removed. For this reason the ohmic loss on the feeding lines was found from the TRL standards and was used to compute the loss on the two open end stubs extending beyond the center of the slots. For the measured results shown in FIG. 5 this loss has already been de-embedded. The loaded Q ($Q_1$) of the cavity is defined as $$Q_1 = \frac{f_o}{\Delta f_{3-dB}} \tag{1}$$

where $f_o$=10.285 GHz is the resonant frequency and $\Delta f_{3-dB}$=0.5 GHz is the 3-dB bandwidth, was found equal to 20.57. The external Q of the resonator, $Q_e$ that includes the input/output loading effects, was found from *Planar Microwave and Millimeter-Wave Components Using Micromachining Technologies,* C. Y. Chi, Ph.D. Dissertation, The University of Michigan, 1995.

$$S21(\text{dB}) = 20\log_{10}\left(\frac{Q_1}{Q_e}\right) \tag{2}$$

to be equal to 21.44. Knowing $Q_e$, and $Q_1$, $Q_u$ was derived from the known relation $$\frac{1}{Q_1} = \frac{1}{Q_u} + \frac{1}{Q_e} \tag{3}$$

Using the above definitions and the measured results, $Q_u$ was found to be equal to 506 and is very close to the theoretical value of 526 for a bulk metallic cavity with the same dimensions as per *Foundations for Microwave Engineering,* R. E. Collin, New York; Mc-Graw-Hill Publishing Company, 1966, pp. 322–325.

The advantages of the proposed micromachined cavity are made clear by the comparisons of Table I. As seen by this Table, the filter assembly having the micromachined metal-lined cavity has a Q similar to conventional bulk metallic waveguide structure but the novel filter is very small and thin which allows for easy integration with MIC and MMIC structures. Despite its monolithic character, the micromachined cavity has a Q that is four times higher than that of traditional microstrip resonators ($Q_u$=125).

TABLE I

| TYPE | SIZE (mm × mm × mm) | $Q_u$ |
|---|---|---|
| 1) metal (conventional) | 19.8 × 22.9 × 10.2 | 8119 |
| 2) metal (conventional) | 16 × 32 × 0.465 | 526 |
| 3) micromachined cavity | 16 × 32 × 0.465 | 506 |
| 4) membrane-microstrip | 5.3 × 7.1 × 0.35 | 234 |
| 5) microstrip | 2.65 × 3.55 × 0.5 | 125 |

Types 1, 2, and 3 are non-planar. Types 4 and 5 are planar.

In summary, a new filter assembly comprises a new micro-resonator chamber and miniature input and output microstrip lines. The new micro-resonator chamber is formed from miniature cavities micromachined into low loss, electrically insulating material substrate wafer. The use of Si micromachining enables the integration of a very small, miniaturized cavity resonator with microstrip components, without affecting the monolithic character of the circuit. The size and weight of this component is significantly reduced compared to conventional resonators made from metallic structures, while it demonstrates an increased quality factor when compared with other planar resonators. Importantly, this high-Q resonator can be used as a basic element in the design and fabrication of high-Q bandpass filters, and has Q well over 100, over 500, and as high as 1,000 or more. Yet, the resonators of the invention have a maximum dimension less than ten centimeters, smaller than one centimeter and are of millimeter or even of sub-millimeter size. The monolithic resonator according to the Example was used at 10 gigahertz operating frequency. At the 100 gigahertz level, the monolithic resonator is one tenth the size of that given in the Example, and has a maximum dimension of a couple of millimeters. At the terahertz operating frequency range, the size is less than a millimeter. Therefore, the filter assembly of the invention having an operating frequency in the gigahertz to terahertz range is extremely small, is a monolithic configuration, and has a maximum dimension a fraction of a centimeter and in the millimeter or sub-millimeter range, making it uniquely suited for integration with monolithic circuits preferred for microelectronic devices.

While this invention has been described in terms of certain embodiments thereof, it is not intended that it be limited to the above description, but rather only to the extent set forth in the following claims.

The embodiments of the invention in which an exclusive property or privilege is claimed are defined in the following claims:

We claim:

1. A high frequency microelectronic filter assembly comprising:

a. at least one microresonator comprising at least two openings and at least one metal-lined resonance chamber micromachined in a layer of dielectric material;

b. input means for transmitting an electromagnetic input signal to said resonance chamber through a first one of said openings;

c. output means for receiving an electromagnetic output signal from said resonance chamber through a second one of said openings;

d. a first region of dielectric material arranged between said input means and said resonance chamber, for support of said input means and to maintain said resonance chamber and said input means separated from one another; and e. a second region of dielectric material arranged between said output means and said resonance chamber, for support of said output means and to maintain said resonance chamber and said output means separated from one another.

2. The filter assembly according to claim 1 having, at least two resonance chambers adjacent one another and openings between selected resonance chambers for coupling said signal between said resonance chambers in a desired path in said microresonator.

3. The filter assembly according to claim 1 having at least two microresonators electrically isolated from one another, each said microresonator coupled to said input means and coupled to separate respective said output means for filtering respective frequencies.

4. A high frequency microelectronic filter assembly comprising:

a. at least one microresonator comprising at least two openings and at least one metal-lined resonance chamber micromachined in a layer of dielectric material;

b. input means for transmitting an electromagnetic input signal to said resonance chamber through a first one of said openings;

c. output means for receiving an electromagnetic output signal from said resonance chamber through a second one of said openings;

d. a first region of dielectric material arranged between said input means and said resonance chamber, for support of said input means and to maintain said resonance chamber and said input means separated from one another; and e. a second region of dielectric material arranged between said output means and said resonance chamber for support of said output means and to maintain said resonance chamber and said output means separated from one another; and where said at leaset one microresonator comprises two microresonators, said input means is arranged between said microresonators, and said respective output means are arranged on opposite outer surfaces of said assembly.

5. The assembly according to claim 4 further comprising a first ground plane layer arranged between said input means and a first one of said microresonators, and a second ground plane layer arranged between said input means and the second one of said microresonators.

6. The assembly according to claim 5 wherein said first ground plane layer is a metal layer, a portion of which is integral with said metal lining of said first microresonator; and wherein said second ground plane layer is a metal layer, a portion of which is integral with said metal lining of said second microresonator.

7. The assembly according to claim 1 having said input and output means arranged spaced apart on an outer surface of said filter assembly.

8. The assembly according to claim 7 wherein said at least two openings are spaced apart from one another in a wall of said metal-lined resonance chamber; said first opening facing said input means for coupling said electromagnetic signal to said resonance chamber from said input means, and said second opening facing said output means for coupling said electromagnetic signal from said resonance chamber to said output means.

9. The assembly according to claim 1 wherein said input and output means are arranged, respectively, on opposite outer surfaces of said filter assembly.

10. The assembly according to claim 9 wherein said metal-lined resonance chamber has first and second opposed walls, said first opening arranged in said first wall facing said input means for coupling said electromagnetic signal to said resonance chamber from said input means, and said second opening in said second wall facing said output means for coupling said electromagnetic signal from said resonance chamber to said output means.

11. The assembly according to claim 1 where said layer of subpart (a) is formed by one or more wafers of said dielectric material, with said cavity micromachined in said one or more wafers.

12. The assembly according to claim 1 comprising said dielectric layer of subpart (a) and a metal layer, said dielectric layer of subpart (a) having first and second major surfaces; said metal layer arranged at said first major surface with said at least two openings formed in said metal layer, a portion of said metal layer being integral with said metal lining of said chamber, and said metal layer being co-extensive with said first major surface.

13. The assembly according to claim 1 where at least one of said first and second regions is not in said layer of subpart (a).

14. The assembly according to claim 12 wherein said input means is a microstrip line and said metal layer functions as a ground plane layer with respect to said microstrip line.

15. The assembly according to claim 1 wherein said dielectric material is a low loss material having Tan Delta less than $10^{-2}$.

16. The assembly according to claim 1 wherein said dielectric material is selected from the group consisting of Si (Silicon), GaAs (Gallium Arsenide), and InP (Indium Phosphide).

17. The assembly according to claim 1 wherein said input means is a transmission line selected from the group consisting of coplanar waveguide (CPW), finite-ground coplanar (FGC), stripline, and microstrip line.

18. The assembly according to claim 1 characterized by a Q factor greater than 300.

19. The assembly according to claim 1 having an operating frequency in the gigahertz to terahertz range.

20. A high frequency filter assembly comprising:

a. at least one microresonator having at least one metal-lined resonance chamber and at least two openings, said chamber comprising a metal-lined, micromachined cavity formed in a layer of dielectric material;

b. input means for transmitting an electromagnetic input signal to said resonance chamber through a first one of said openings;

c. output means for receiving an electromagnetic output signal from said resonance chamber through a second one of said openings;

d. a first region of dielectric material arranged between said input means and said resonance chamber to maintain said resonance chamber and said input means separated from one another;

e. a second region of dielectric material arranged between said output means and said resonance chamber to maintain said resonance chamber and said output means separated from one another; where at least one of said first and second regions is not a part of said layer of subpart (a); and said filter assembly further characterized by an operating frequency in the gigahertz to terahertz range, and a Q factor greater than 300.

21. The assembly according to claim 20 wherein said input means is a transmission line selected from the group consisting of coplanar waveguide (CPW), finite-ground coplanar (FGC), stripline, and microstrip line.

22. The filter assembly according to claim 20 having at least two resonance chambers adjacent one another and openings between selected resonance chambers for coupling said signal between said resonance chambers in a desired path in said microresonator.

23. A high frequency filter assembly comprising:

a. at least one microresonator having at least one metal-lined resonance chamber and at least two openings, said chamber comprising a metal-lined, micromachined cavity formed in a layer of dielectric material;

b. input means for transmitting an electromagnetic input signal to said resonance chamber through a first one of said openings;

c. output means for receiving an electromagnetic output signal from said resonance chamber through a second one of said openings;

d. a first region of dielectric material arranged between said input means and said resonance chamber to maintain said resonance chamber and said input means separated from one another;

e. a second region of dielectric material arranged between said output means and said resonance chamber to maintain said resonance chamber and said output means separated from one another; where at least one of said first and second regions is not a part of said layer of subpart (a): and said at least one microresonator comprises a plurality of microresonators electrically isolated from one another, each said microresonator coupled to said input means and coupled to separate respective said output means for filtering respective frequencies; said filter assembly further characterized by an operating frequency in the gigahertz to terahertz range, and a O factor greater than 300.

24. The filter assembly according to claim 23 which comprises two microresonators, said input means is arranged between said microresonators, and said respective output means are arranged on opposite outer surfaces of said assembly.

25. The assembly according to claim 1 where both of said first and second regions are not in said layer of subpart (a).

26. The assembly according to claim 4 where at least one of said first and second regions is not in said layer of subpart (a).

27. The assembly according to claim 4 where both of said first and second regions are not in said layer of subpart (a).

* * * * *